United States Patent [19]

Korte et al.

[11] Patent Number: 4,630,619

[45] Date of Patent: Dec. 23, 1986

[54] PROCESS FOR TREATING TOBACCO

[75] Inventors: Kevin R. Korte, Louisville, Ky.; Dan T. Wu, Surabaya, Indonesia

[73] Assignee: Brown & Williamson Tobacco Corp., Louisville, Ky.

[21] Appl. No.: 566,750

[22] Filed: Dec. 16, 1983

[51] Int. Cl.[4] ..... A24B 3/18

[52] U.S. Cl. ..... 131/296; 131/900

[58] Field of Search ..... 131/291, 292, 296, 900

*Primary Examiner*—V. Millin

*Attorney, Agent, or Firm*—Charles G. Lamb

[57] ABSTRACT

An improved tobacco treating process comprising cooling tobacco in a liquid nitrogen bath, impregnating the mixture with carbon dioxide gas under preselected pressure conditions, releasing the pressure and subjecting the so treated tobacco to drying gases with temperatures at least above about 250° F. with wet bulb temperatures in the range of at least about 150° F. with a maximum of 212° F.

8 Claims, No Drawings

PROCESS FOR TREATING TOBACCO

BACKGROUND OF THE INVENTION (1) Field of the Invention

The invention relates to processes for treating tobacco and more particularly to an improved process for expanding and drying tobacco.

(2) Brief Description of the Prior Art

It is known in the prior art to expand tobacco with pressurized carbon dioxide, to subsequently reduce the pressure to solidify the carbon dioxide within the tobacco structure, to heat the tobacco to vaporize the solid carbon dioxide and to then dry the expanded tobacco. It also is known in the prior art to cool and even to freeze tobacco prior to further processing.

For example expired U.S. Pat. No. 3,223,090, inventor, D. G. Strubel et al and issued on Dec. 14, 1965, teaches flash freezing tubing filled with water-tobacco mixture by immersing the tubing in a liquid nitrogen or dry ice prior to further processing of the tobacco.

Unexpired U.S. Pat. No. 4,165,618, inventor, Lewis Tryee, issued Aug. 28, 1979; teaches treating tobacco products with a recoverable liquid cryogen such as nitrogen or carbon dioxide at equilibrium to minimize leaching of the tobacco components.

Unexpired U.S. Pat. No. 4,258,729, inventor, Roger Z. de la Burde et al, issued Mar. 31, 1981, teaches "presnowing" tobacco with finely divided solid carbon dioxide prior to gaseous carbon dioxide treatment in amounts of 5–50% by weight of tobacco to increase the amount of carbon dioxide retained by the tobacco.

Unexpired U.S. Pat. No. 4,289,148, issued to Klaus-Dieter Ziehn on Sept. 15, 1981, teaches treating tobacco with nitrogen or argon at preselected temperatures and pressures, releasing the pressure and then heating the tobacco at preselected temperatures.

Unexpired U.S. Pat. No. 4,235,250, inventor, Francis V. Utsch and issued on Nov. 25, 1980, and the two unexpired U.S. Pat. Nos. 4,258,729 and 4,333,483, inventors, Roger Z. de la Burde, Patrick E. Aument, and the same Francis V. Utsch, all teaching presnowing tobacco with finely divided solid carbon dioxide prior to gaseous carbon dioxide treatment in amounts of 5–50% by weight of tobacco to increase the amount of carbon dioxide retained by the tobacco.

As can be seen from the above, certain of the prior art practices of treating tobacco materials have taught the utilization of a liquid nitrogen bath and other practices have taught the utilization of a carbon dioxide treating step in either a gaseous or solid form. However, none of the past practices have suggested the novel process of the present invention which combines the steps of liquid nitrogen treatment, gaseous carbon dioxide treatment and drying with gases with temperature at least above about 250° F. with wet bulb temperatures in the range of at least about 150° F. to a maximum of 212° F. in a tobacco treating process which requires a minimum of time, equipment and other operating costs and which, at the same time, provides an improved, homogenous tobacco product having a comparatively high fill value improvement with comparatively substantially equal or sometimes even lower alkaloids and total sugars losses.

SUMMARY OF THE INVENTION

More particularly the present invention provides an improved tobacco treating process comprising immersing tobacco in a liquid nitrogen bath at a preselected low temperature and for a sufficient period of time to cool the tobacco in a uniform manner, treating the cooled tobacco with gaseous carbon dioxide at a preselected pressure and for a sufficient period of time to allow the gaseous carbon dioxide to condense evenly on the surface and into the pores of the tobacco, reducing the gaseous pressure, and drying the so treated tobacco with hot gases to arrive at the final expanded tobacco product of the process.

It is to be understood that various changes can be made by one skilled in the art in the several steps of the process disclosed herein without departing from the scope or spirit of the present invention. For example, the tobacco drying step of the experiments described hereinafter is like that disclosed in unexpired U.S. Pat. No. 4,167,191, inventors, John N. Jewell et al and issued on Sept. 11, 1979, but any one of several other now well known tobacco drying/expanding steps could be utilized in the inventive process. Further, the pressures, temperatures and residence times of each treating step can be varied within limits to arrive at a final tobacco product.

DETAILED DESCRIPTION OF THE INVENTION

TABLES 1 through 3 set forth below show the comparative experimental parameters (TABLE 1), the comparative physical results (TABLE 2), and the comparative chemical results (TABLE 3) on the experimental treatment of six comparable tobacco samples (the average of two replicate runs for each reading) of a cut mixture of the flue-cured and Burley tobaccos with a moisture content of approximately 22%. "Column A" in each of the three tables relates to tobacco samples treated with only gaseous carbon dioxide ($GCO_2$). Column "B" relates to tobacco samples treated in accordance with the inventive process including a liquid nitrogen ($LN_2$) immersion step and a subsequent gaseous carbon dioxide ($GCO_2$) treating step. Column "C" relates to tobacco samples treated only with liquid carbon dioxide ($LCO_2$). TABLES 2 and 3 further include a column labeled "STARTING MATERIAL" which includes average starting data on the tobacco sample tested.

All experiments set forth in TABLES 1–3 were conducted in a pressure vessel in an approximate range of 760–820 psig pressure in 250–300 gram amounts in view of the capacity limitations of the pressure vessel utilized in the experiments.

In the expansion/drying step, a drying process such as that disclosed in U.S. Pat. No. 4,167,191, inventors, John N. Jewell et al, issued Sept. 11, 1979 was utilized. This process comprises drying the expanded tobacco at a temperature within the range of approximately from about 250° F. to about 650° F. in the presence of an absolute humidity at a level above that which will provide a wet bulb temperature of at least about 150° F. In the experiments of TABLES 1–3, the inlet dryer temperature was held at approximately 650° F. with a wet bulb temperature of 210° F. A small dryer and tangential separator arrangement similar to that disclosed in FIG. 1 of Jewel U.S. Pat. No. 4,167,191 was utilized with only one dryer chamber being used instead of three (not shown). The production rate was at a substantially equivalent rate. After drying, the expanded samples were placed in a conditioning cabinet controlled at 75° F. and 60%RH to bring their moisture to equilibrium conditions. Spray reordering was not performed due to the possible variance it might have introduced to the process response.

TABLES 1-3 of the experiments are summarized as follows, the readings, as above mentioned, representing an average of two replicate runs for each treatment. All experiments were dried at approximately the same production rate.

TABLE 1

| EXPERIMENTAL PARAMETERS | "A" $GCO_2$ | "B" $LN_2/GCO_2$ | "C" $LCO_2$ |
|---|---|---|---|
| Impregnation Pressure (PSIG) | 813 | 767 | 813 |
| Dryer | | | |
| Inlet Gas Temp. (°F.) | 657 | 660 | 653 |
| Wet Bulb Temp. (°F.) | 210 | 210 | 210 |

TABLE 2

| PHYSICAL PROPERTY SUMMARY | STARTING MATERIAL | "A" $GCO_2$ | "B" $LN_2/GCO_2$ | "C" $LCO_2$ |
|---|---|---|---|---|
| Moisture (%) | 22.6 | | | |
| Exit Dryer | — | 4.3 | 4.3 | 4.6 |
| Cond. Product | 12.5 | 11.7 | 11.4 | 11.6 |
| VCFV (mg/cc) | 216 | 127 | 108 | 92 |
| VCFV (cc/g) | 4.6 | 7.9 | 9.3 | 10.9 |
| FVI (Volumetric %) | Control | 72 | 102 | 137 |
| BWFV (cc/g) at E.M. | 4.8 | 7.4 | 8.3 | 9.3 |
| FVI (Volumetric %) | Control | 54 | 73 | 94 |
| PSD (%) | | | | |
| +6 Mesh | 32.3 | 26.6 | 18.4 | 18.2 |
| −14 Mesh | 14.2 | 18.7 | 19.9 | 19.1 |

TABLE 3

| CHEMICAL PROPERTY SUMMARY | STARTING MATERIAL | "A" $GCO_2$ | "B" $LN_2/GCO_2$ | "C" $LCO_2$ |
|---|---|---|---|---|
| Alkaloid (%) | 2.69 | 2.10 | 1.91 | 1.84 |
| A.L. (%) | Control | −22 | −29 | −32 |
| Reducing Sugar (%) | 5.3 | 4.6 | 4.5 | 4.3 |
| R.S.L. (%) | Control | −13 | −15 | −19 |
| Total Sugar (%) | 6.2 | 5.5 | 5.6 | 5.1 |
| T.S.L. (%) | Control | −11 | −10 | −18 |

The Vibrating/Compression Fill Value (VCFV) test, the results of which are shown in TABLE 2, is a constant force/variable volume method of measuring fill value and is reported in two ways at TABLE 2, namely mg/cc and cc/g.

The Borgwaldt Fill Value (BWFV) test, the results of which are also shown in TABLE 2, is obtained by compressing a defined weight of test tobacco in a cylinder under a 3 Kg (free fall) load for a duration of 30 seconds. Sample weight and height of the compressed tobacco column serve to calculate filling power expressed in cc/gr.

In the process steps which yielded the data set forth in Column "B" of the above TABLES, the first step, namely the liquid nitrogen ($LN_2$) immersion of the tobacco core was at approximately −320° F. (the boiling point of ($LN_2$) for a period of approximately one minute. In the second step, involving treatment with gaseous carbon dioxide ($GCO_2$) the treatment time also was for a period of approximately one minute.

From TABLE 2, it can be observed that the fill value improvement of the tobacco expanded through the inventive process, which included the first step of liquid nitrogen immersion (Column "B"-$LN_2/GCO_2$), was substantially better than the fill value improvement arrived at by treating the product with gaseous carbon dioxide alone (Column "A"-$GCO_2$) and it is believed that the $LN_2$ chilling before gaseous carbon dioxide impregnation serves to improve gaseous carbon dioxide condensation on and into the pores of the treated tobacco product core.

Although the fill value improvement of the tobacco product treated by the inventive process ($LN_2/GCO_2$) was less than that of the tobacco product treated by liquid carbon dioxide ($LCO_2$) alone (TABLE 2-Columns "B" and "C"), From TABLE 3, it can be seen that the alkaloids and total sugars losses were comparatively substantially equal or sometimes even lower and, in fact, the total sugars losses were less than those for a tobacco product treated with gaseous carbon dioxide ($GCO_2$-Column "A") even though the fill value improvement was substantially higher—as afore noted.

It is to be understood that various changes can be made by one skilled in the art in the several steps of the inventive process described herein without departing from the scope or spirit of the present invention. For example, it may be desirable to raise the chilling temperature in the $LN_2$ immersion step above the boiling point of liquid nitrogen (−320° F.) in order to avoid possible damage to the tobacco cellulose structure and to improve particle size distribution.

The invention claimed is:

1. An improved tobacco treating process comprising:
   immersing a preselected tobacco product in a liquid nitrogen bath at a preselected low temperature for a sufficient period of time to cool the tobacco product in a uniform manner;
   treating the cooled tobacco product with gaseous carbon dioxide at a preselected pressure and for a sufficient period of time to allow the gaseous carbon dioxide to condense evenly on the surface and into the pores of the tobacco product; and,
   reducing the gaseous pressure and drying the gaseous tobacco product with hot gases to arrive at a final expanded tobacco product.

2. The process of claim 1, said immersion of the tobacco product into the liquid nitrogen bath being at approximately −320° F.—the boiling point of liquid nitrogen.

3. The process of claim 1, said immersion of the tobacco product into the liquid nitrogen bath being for a period of approximately one minute.

4. The process of claim 1, said treatment of said cooled tobacco product with gaseous carbon dioxide being for a period of approximately one minute.

5. The process of claim 1, said treatment of said cooled tobacco product with gaseous carbon dioxide being in a pressure range approximately 760–820 psig.

6. The process of claim 1, said drying step being at a temperature range of approximately from about 250° F. to about 650° F. in the presence of an absolute humidity at a level above that which will provide a wet bulb temperature of at least about 150° F.

7. The process of claim 1, said drying step being at a temperature of approximately 650° F. in the presence of an absolute humidity at a level above that which will provide a wet bulb temperature of approximately 210° F.

8. The process of claim 1, said immersion of the tobacco product into the liquid nitrogen being for a period of approximately one minute and at a temperature of approximately −320° F.;

said treatment of the cooled tobacco product with gaseous carbon dioxide being for a period of one minute at a pressure range of approximately 760–820 psig; and said drying step being at a temperature of approximately 650° F. in the presence of an absolute humidity at a level above that which will provide a wet bulb temperature of approximately 210° F.

* * * * *